US005328188A

United States Patent [19]

Brotz

[11] Patent Number: 5,328,188

[45] **Date of Patent: * Jul. 12, 1994**

[54] MAGNETIC BOARD GAME

[76] Inventor: Gregory R. Brotz, P.O. Box 1322, Sheboygan, Wis. 53081

[ * ] Notice: The portion of the term of this patent subsequent to May 11, 2010 has been disclaimed.

[21] Appl. No.: 60,593

[22] Filed: May 11, 1993

Related U.S. Application Data

[63] Continuation-in-part of Ser. No. 765,542, Sep. 25, 1991, Pat. No. 5,209,486.

[51] Int. Cl.[5] ..... A63F 3/00

[52] U.S. Cl. ..... 273/239; 273/450; 273/456; 273/129 R; 273/290

[58] Field of Search ..... 273/336, 337, 118 A, 273/119 R, 119 A, 239, 85 E, 85 F, 85 R, 86 B, 126 R, 126 A, 456, 443, 450, 459, 129 R, 290, 345; D21/14

[56] References Cited

U.S. PATENT DOCUMENTS

| | | | |
|---|---|---|---|
| 2,819,904 | 1/1958 | Nelson et al. | 273/239 |
| 2,951,703 | 9/1960 | Arnold | 273/239 |
| 3,091,459 | 5/1963 | Lindman | 273/239 |
| 3,650,534 | 3/1972 | Collett | 273/239 |
| 3,765,679 | 10/1973 | O'Connell | 273/239 |
| 4,002,342 | 1/1977 | Biggs | 273/239 |
| 4,172,597 | 10/1979 | Smith et al. | 273/239 |
| 4,305,587 | 12/1981 | O'Grady | 273/345 |
| 5,139,272 | 8/1992 | Villafuerte | 273/345 |
| 5,209,486 | 5/1993 | Brotz | 273/139 |

FOREIGN PATENT DOCUMENTS

| | | | |
|---|---|---|---|
| 1134934 | 4/1957 | France | 273/239 |

*Primary Examiner*—V. Millin
*Assistant Examiner*—Sebastiano Passaniti
*Attorney, Agent, or Firm*—William Nitkin

[57] ABSTRACT

A game having a magnetically permeable game board areas, each of the areas having a magnet associated therewith and a plurality of magnetic game pieces to be propelled by a player by a repeller toward the game board in an effort to position the magnetic game piece over an area having the highest scoring value associated therewith.

6 Claims, 5 Drawing Sheets

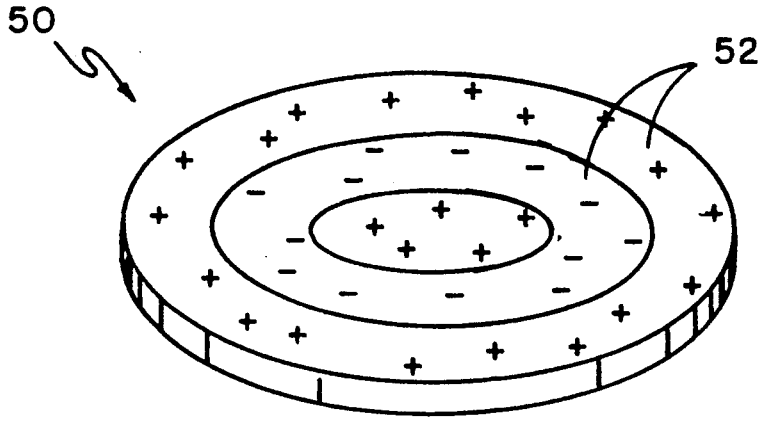
FIG. 5
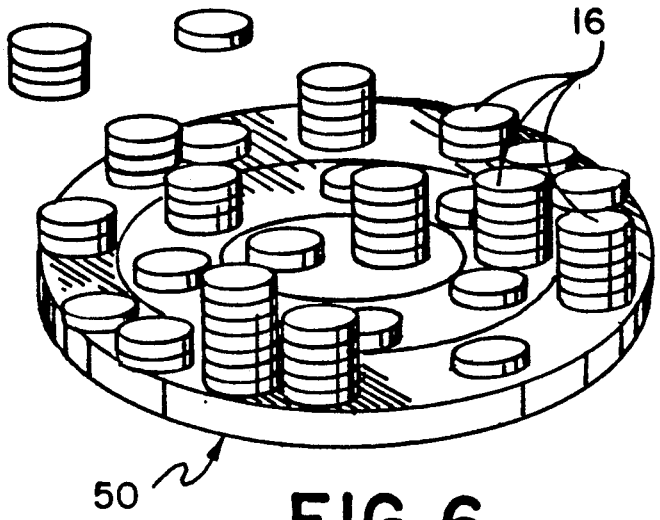
FIG. 6
FIG. 7
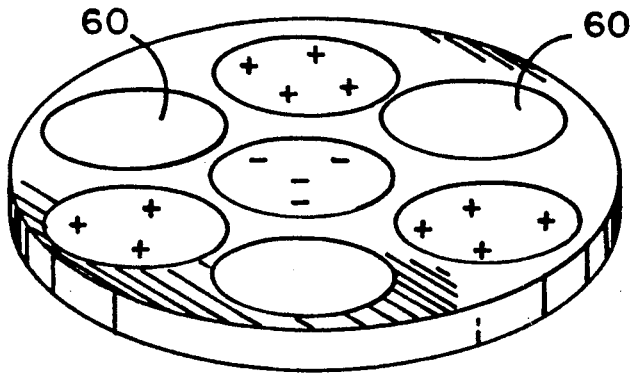

MAGNETIC BOARD GAME

This application is a continuation-in-part of my previous application filed Sep. 25, 1991, Ser. No. 765,542 entitled Magnetic Game, now U.S. Pat. No. 5,209,486.

BACKGROUND OF THE INVENTION

1. Field of the Invention

This invention is a game and method of play and more particularly relates to a game having a game board utilizing magnetic game pieces which are flipped by a player onto a game board playing surface having areas thereon with a particular scoring value associated with each area. The player with the most magnetic game pieces falling on the higher value areas, alone or stacked, being the winner of the game.

2. Description of the Prior Art

Tossing games are well known in the prior art. Many tossing games provide a plurality of holes or spaces into which playing pieces, such as bags or balls, are thrown. The tossing skill of a player is tested as hard to reach spaces have higher scoring values associated therewith than easy-to-reach spaces.

SUMMARY OF THE INVENTION

It is an object of this invention to provide a game wherein magnetic force is used to attract and retain game pieces on game boards divided into a plurality of surface areas and to attract or repel other game pieces on such areas. The players can toss or propel magnetic playing pieces, and the magnetic playing pieces can land on one of the areas delineated on the game board or on top of other playing pieces. Under each area is a magnet to attract or repel one or more magnetic game pieces. Also such areas in one embodiment can be formed from shaped pieces of magnetic sheet material. The magnetic game pieces will stack on the areas to which they are attracted along with interaction between the playing causing their movement from area to area on the game board due to different magnetic polarities of different game pieces coming into proximity with one another and attracting or repelling to cause chain reactions of game piece movement on the game board. Different colored magnetic game pieces can be used by each player for scoring purposes.

BRIEF DESCRIPTION OF THE DRAWINGS

FIG. 5 illustrates an alternate game board having concentric ring scoring areas.

FIG. 6 illustrates magnetic game pieces on the game board of FIG. 5.

FIG. 7 illustrates another embodiment of the game board of this invention having larger areas of different polarity and non-magnetized metal areas to attract game pieces of any downward-facing polarity.

DESCRIPTION OF THE PREFERRED EMBODIMENTS(S)

Figure 1:
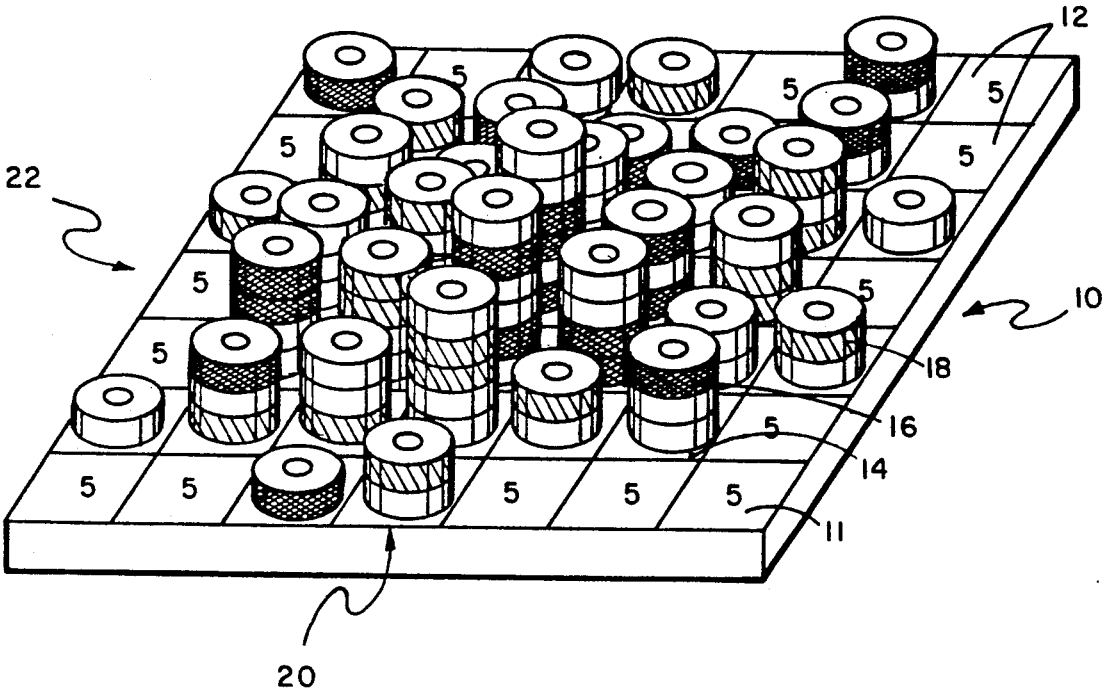
FIG. 1 illustrates one embodiment of the game board of this invention with a plurality of magnetic game pieces stacked thereon.

FIG. 1 illustrates one embodiment of game board 10 of this invention which has a gridwork thereon which includes a plurality of rows 22 and columns 20 to form a plurality of areas 12. On each grid area is imprinted a score, the centermost grid area 30 seen on FIG. 2 having a higher scoring value than the peripheral grid areas. For example, the perimeter grid area 11, seen in FIGS. 1 and 2, can have a scoring value of 5 points while the next inward grid area 26 can have a scoring value of 10 points, and the next inward grid area 28 can have a scoring value of 25 points while the centermost grid area 30 has a scoring value of 50 points. Other scoring arrangements can be used, and the scoring system described herein is for illustrative purposes only.

Figure 2:
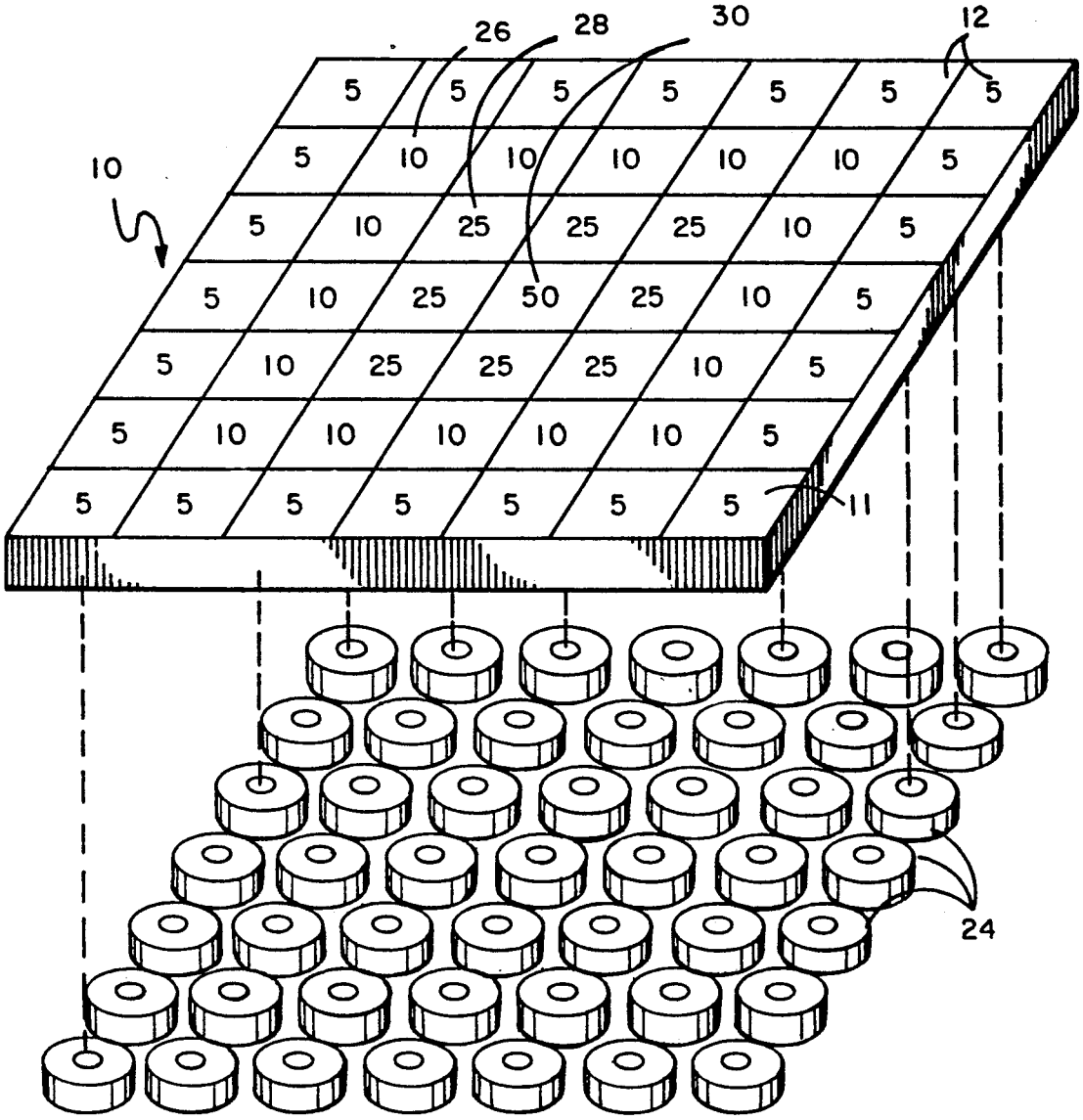
FIG. 2 illustrates the game board of FIG. 1 with no game pieces thereon showing the magnets that are disposed under each area with each magnet being shown separated downward therefrom as an illustration of its positioning under its respective area.
Figure 3:
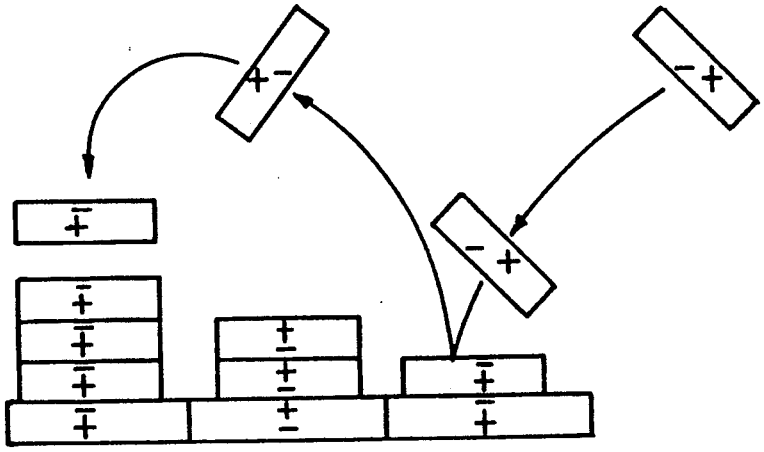
FIG. 3 illustrates a game piece being repelled by the first game piece contacted and being attracted to another game piece.

The game board can be made of a magnetic field permeable material such as cardboard, thin plastic or the like. Disposed beneath each of the grid areas is a separate magnet 24 as seen in FIG. 2. Magnets 24 are shown moved downward away from game board 10 in this Figure, but in use each of these magnets is permanently positioned under a separate grid area 12. During play, each player tosses or otherwise propels his magnetic game pieces, and when they land on the game board, such game pieces will automatically be attracted to and align with the closest magnet 24 under the game board. The game pieces may come close to a grid area or playing piece having a like magnetic pole in which case it will be repelled to another grid area or game piece, as seen in FIG. 3. The action of such magnetic repulsion can cause other game pieces already in place on the board to be attracted or repelled. The attraction or repulsion causes further movement of the game pieces to become rearranged by change interaction of the magnetic pole directions of the pieces with such flying of magnetic pieces somewhat like a chain reaction. Each player, in turn or all at once, will continue to shoot his magnetic game pieces, and the magnetic game pieces will stack upon one another as seen in FIG. 1 due to their magnetic attraction to one another and the magnetic attraction of the magnets under the game board. The magnetic game pieces can have varying thicknesses. Each player's magnetic game pieces can be designated by a different color for each player. A plurality of magnetic game pieces 16 may stack over one grid area 14 and the winner would be the player having the highest score. Other scoring systems could also be utilized in the game of this invention.

Figure 8:
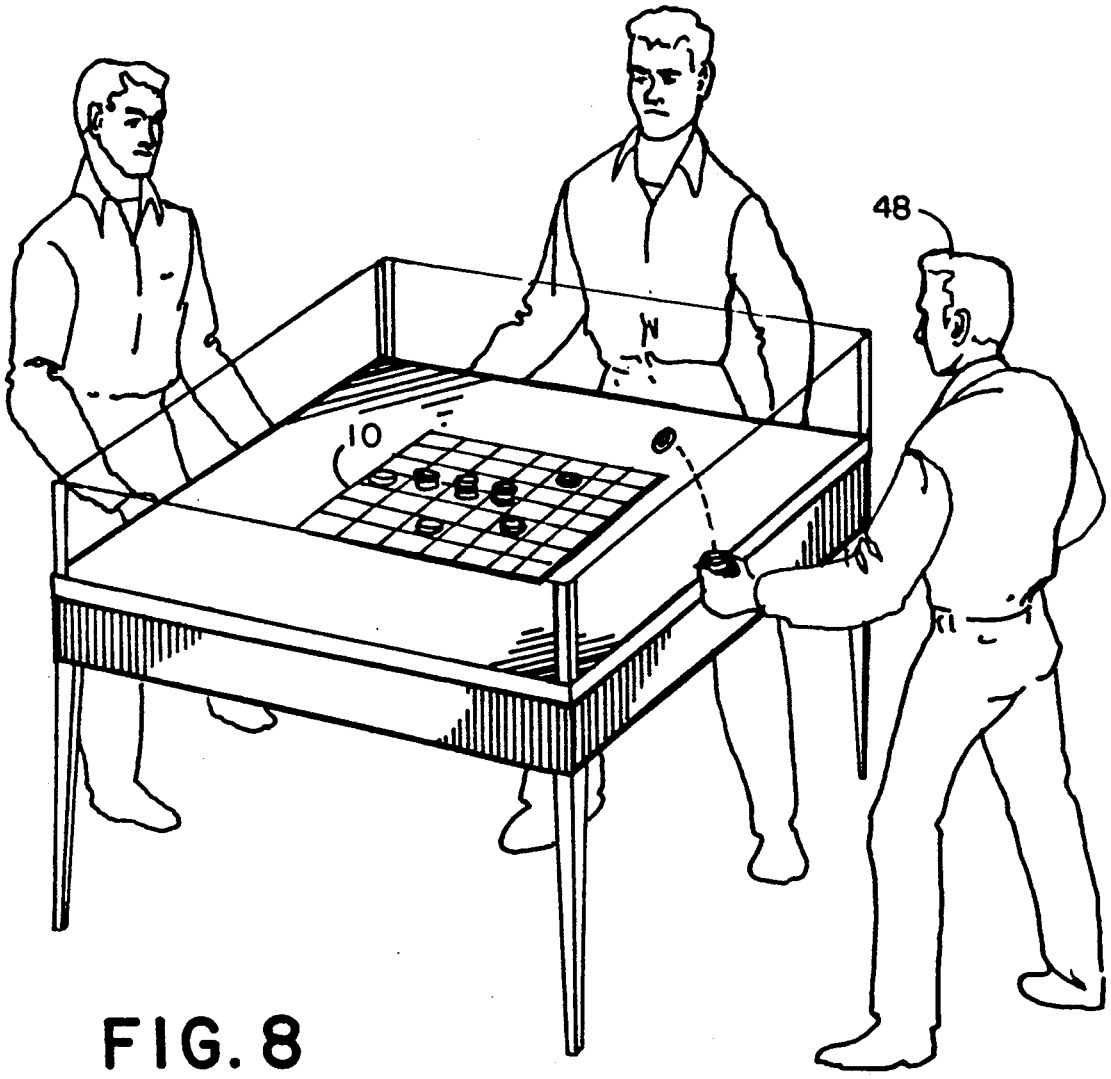
FIG. 8 illustrates a perspective view of individuals playing the game of this invention.

FIG. 8 shows player 48 with magnetic game piece 38 being flipped toward game board 10 where it falls and is attracted to the nearest grid area or game piece of opposite polarity. Other means to propel the magnetic game pieces can also be utilized in playing the game of this invention such as shooting the game pieces toward the game board by a snapping action of the pieces with a second game piece pressed down on the edge of another game piece to be propelled toward the game board such as in a tiddlywinks game.

Figure 4:
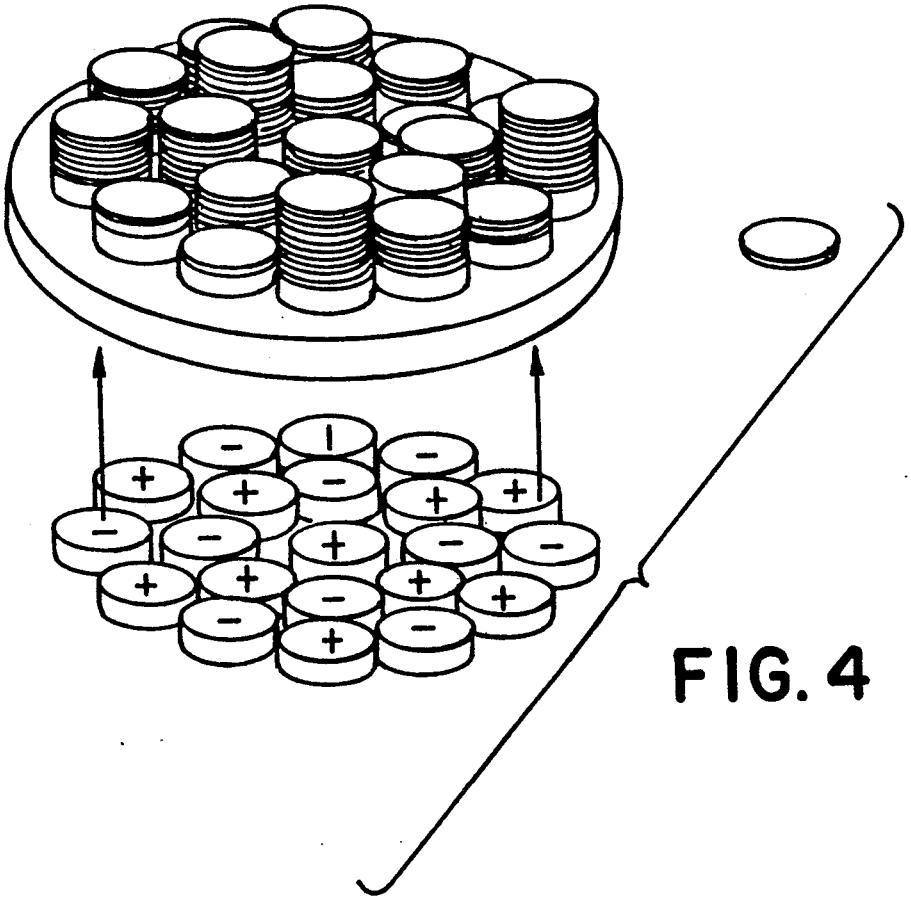
FIG. 4 illustrates a game board with magnets thereunder having different upward-facing polarities, such magnets shown separated downward therefrom as an illustration of their positioning under their respective area.

The game board can have a variety of shapes and magnetic polarity arrangements. One such alternate embodiment of the game board is seen in FIG. 5 wherein a circular game board 50 is illustrated having concentric rings 52, each with a different polarity and a different scoring value with the higher scoring values often being the smaller rings. Each ring can be cut from sheets of magnetic material to form such concentric rings. The game is played in the same manner as discussed above with the magnetic game pieces 16 propelled onto the game board as seen in FIG. 6. Each ring of FIG. 5 has a different magnetic polarity as seen by the + or − indications. This same alternation of positive and negative polarity areas is also seen in FIG. 4. In addition, other metal, non-magnetized, ferrous areas 60 that will attract either pole of the game piece can also be used to produce a random pole base, as seen in FIG. 7.

Two or more players can play the game of this invention, and the players must exercise skill in aiming their magnetic playing pieces toward those areas on the game board having the highest scoring values. However, an element of chance also enters into the playing of this game due to repulsion and attraction of adjacent game pieces as each game piece is propelled toward the game board.

Although the present invention has been described with reference to particular embodiments, it will be apparent to those skilled in the art that variations and modifications can be substituted therefor without departing from the principles and spirit of the invention.

I claim:

1. A method for playing a game by a player comprising the steps of:

providing a game board formed of magnetic field permeable material and a plurality of magnetic game pieces, said game board having a surface with a plurality of adjoining areas defined on said surface with each of said areas having a magnet of the same or different polarity and each of said areas having a scoring value associated therewith;

propelling a first magnetic game piece onto the surface of said game board, the game piece being attracted to one of said areas and landing thereon;

propelling a series of additional magnetic game pieces onto said game board so that said additional game pieces are each attracted to and land on one of said areas whether or not already occupied by one or more of the previously propelled game pieces, with those game pieces landing on an already occupied area stacking on the one or more game pieces already occupying said area, the stacking of game pieces in an area of a given scoring value increasing the score of any player to a degree grater than would occur without stacking of the game pieces;

attracting game pieces of different polarities to selected ones of said areas;

repelling game pieces from said areas of like polarities and causing said repelled game pieces to travel to other ones of said areas of the game board or to other game pieces of opposite polarity to same game piece; and causing movement of other game pieces already on the game board by the attraction or repulsion to said repelled game pieces.

2. A game for two or more players comprising:

a game board of magnetic field permeable material having a surface area and a plurality of adjacent areas defined on said surface, each of said areas having a scoring value associated therewith;

a plurality of magnets each disposed under one of said areas;

a plurality of magnetic game pieces each having different indicia for each player; and means to propel one of said plurality of magnetic game piece by a player toward said game board such that in a first mode said magnetic game piece is attracted by magnetic attraction to one of said areas and positions itself over the magnet beneath said area and in a second mode said magnetic game piece is attached by magnetic attraction to a magnetic game piece previously positioned over one of said areas with said magnetic game pieces stackable on one another by magnetic attraction wherein the player having the most magnetic game pieces stacked over the areas with the highest scoring values being the winner of the game.

3. The game of claim 2 wherein said magnets under said areas are of different polarities.

4. The game of claim 3 wherein said areas are formed of segments of magnetic sheet material.

5. The game of claim 4 wherein said sheets of magnetic material are formed in concentric rings.

6. The game of claim 2 further including at least one adjacent area of a non-magnetic ferrous material.

* * * * *